US008314700B2

(12) United States Patent
Hamzy

(10) Patent No.: US 8,314,700 B2
(45) Date of Patent: Nov. 20, 2012

(54) DETERRING THEFT OF MOBILE ELECTRONIC DEVICES

(75) Inventor: Mark Joseph Hamzy, Round Rock, TX (US)

(73) Assignee: International Business Machines Corporation, Armonk, NY (US)

( * ) Notice: Subject to any disclaimer, the term of this patent is extended or adjusted under 35 U.S.C. 154(b) by 1886 days.

(21) Appl. No.: 11/201,686

(22) Filed: Aug. 11, 2005

(65) Prior Publication Data

US 2007/0035391 A1 Feb. 15, 2007

(51) Int. Cl.
*G08B 13/14* (2006.01)

(52) U.S. Cl. ..... 340/571; 340/568.1; 726/35

(58) Field of Classification Search ..... 340/568.1, 340/568.2, 571, 686.1
See application file for complete search history.

(56) References Cited

U.S. PATENT DOCUMENTS 5,406,261 A * 4/1995 Glenn ..... 340/571
5,675,321 A * 10/1997 McBride ..... 340/568.2
5,748,083 A * 5/1998 Rietkerk ..... 340/568.2
5,748,084 A * 5/1998 Isikoff ..... 340/568.1
6,748,541 B1 * 6/2004 Margalit et al. ..... 726/9
2005/0149752 A1 * 7/2005 Johnson et al. ..... 713/201
2005/0206353 A1 * 9/2005 Sengoku ..... 323/210
2006/0075414 A1 * 4/2006 Rapp et al. ..... 720/600

OTHER PUBLICATIONS

V.D. Khanna, S. Kumar and M. Sri-Jayantha, "Single Dual Purpose Shock Sensor and Actuator Latch for a Direct Access Storage Device", IBM Technical Disclosure Bulletin (vol. 40 No. 12 Dec. 1997, pp. 155-159).
V. Khanna, S. Kumar and M. Sri-Jayantha, "Palm Sensor for Handheld Computing Devices", IBM Technical Disclosure Bulletin (vol. 40 No. 12 Dec. 1997, pp. 225-228.
"SonicLock Motion-Detecting Alarm", ACCO Brands Inc. (www.kensington.com/html/1130.html).
"Active Protection system overview—ThinkPad General", IBM Corp. (www-307.ibm.com/pc/support/site.wss/document.do?Indocid=MIGR-53167).
Albrecth TR, Alexopoulos PS, "Quiescent Active Retract System for Disk File", IBM Technical Disclosure Bulletin (vol. 39 No. 11 Nov. 1996, pp. 181-182).

* cited by examiner

*Primary Examiner* — George Bugg
*Assistant Examiner* — Anne Lai
(74) *Attorney, Agent, or Firm* — Yee & Associates, P.C.

(57) ABSTRACT

A method and system for notifying an owner of a mobile electronic device of an unauthorized movement of the mobile electronic device from a physical location.

20 Claims, 3 Drawing Sheets

DETERRING THEFT OF MOBILE ELECTRONIC DEVICES

BACKGROUND

1. Technical Field of the Present Invention

The present invention generally relates to electronic devices, and more specifically, to methods, systems, and computer program products that assist in preventing the theft of mobile electronic devices.

2. Description of Related Art

The advancement and proliferation of electronic devices has been accelerated by the demands of consumers for increased mobility. These demands have resulted, in part, from the expectation of the work place that an employee should be reachable twenty-four hours a day seven days a week (24/7), and from the desires of individuals to maintain active lifestyles while retaining the ability to have instantaneous communication.

These mobile electronic devices are often physically small and designed so as to easily blend with any attire. Unfortunately, it is these very characteristics that make the mobile electronic device such an easy target for theft. This is particularly true for those mobile electronic devices that are expensive and in high demand (e.g. laptops).

At one time, it was considered to be the responsibility of the owner to keep a watchful eye on their mobile electronic device in order to avoid theft. Fortunately, the electronic industry has recently taken an active role in providing solutions that assist in the detection of unauthorized use of these mobile electronic devices. These solutions have, primarily, focused on owner recognition using power-on passwords, finger print recognition and the like to disable a mobile electronic device upon the attempted use by an unauthorized individual.

Although these solutions are helpful to protect personal and confidential information after a theft has occurred, consumers and businesses require a solution that assists in the avoidance of the initial theft.

It would, therefore, be a distinct advantage to have a method, system, and computer program product that would assist in the detection of the initial theft or unauthorized movement of the mobile electronic device.

SUMMARY OF THE PRESENT INVENTION

In one aspect, the present invention is a method of alerting an individual of unauthorized movement of a mobile electronic device having a hard disk drive with a motion sensor. The method includes the step of detecting an unauthorized movement of the mobile electronic device from a physical location using the motion sensor. The method further includes the step of alerting the owner of the mobile electronic device of the unauthorized movement.

The method can include the additional step of destroying the personal or confidential data stored on the mobile electronic device if the owner fails to take a specified action after a predetermined period of time has elapsed since the unauthorized movement of the mobile electronic device.

The movement can be considered unauthorized if it exceeds the value of a predetermined parameter such as distance.

Alerting the owner of unauthorized movement can take the form of sounding an alarm or providing a visual warning.

The mobile device can be, for example, a laptop that includes a hard disk drive having a motion sensor.

BRIEF DESCRIPTION OF THE DRAWINGS

The present invention will be better understood and its numerous advantages will become more apparent to those skilled in the art by reference to the following drawings, in conjunction with the accompanying specification, in which.

DETAILED DESCRIPTION OF THE PREFERRED EMBODIMENT OF THE PRESENT INVENTION

The present invention is a method, system, and computer program product for assisting in the detection of an unauthorized movement of a mobile electronic device. This accomplished by using one or more motion detector(s) in combination with user specified parameters for determining the range of movements that are to be considered unauthorized. Any unauthorized movement of the mobile electronic device results in an alarm or other attention focusing warning being provided to the owner. As an additional option, the owner can specify that the failure to take remedial action within a predefined period of time will result in the destruction of certain personal or confidential information.

Figure 1:
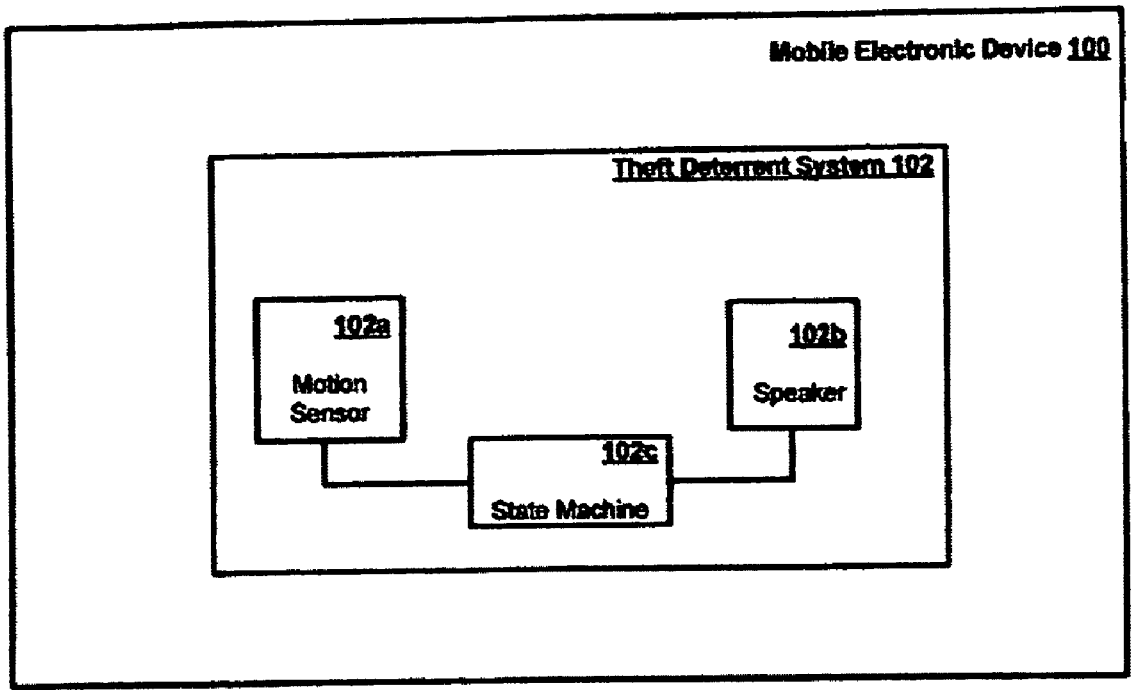
FIG. 1 is a diagram of a mobile electronic device that includes a theft deterrent system with a state machine implemented according to a preferred embodiment of the present invention.

Reference now being made to FIG. 1, a mobile electronic device 100 is shown that includes a Theft Deterrent System (TDS) 102 according to a preferred embodiment of the present invention.

The mobile electronic device 100 can be, for example, a cell phone, PDA, MP3 player, portable game machine, laptop or the like.

The TDS 102 includes one or more motion sensors 102*a*, an audio speaker 102*b* or other device capable of focusing the attention of the owner (e.g. flashing lights), and a state machine 102*c*.

Motion sensor 102*a* can be, for example, a mercury based switch, an electrical or mechanical based switch, or any other circuitry intended to provide an indication when movement of the motion sensor 102*a* occurs in sufficient detail to detect movement of the mobile electronic device 100 from a physical location.

State Machine 102*c* is responsible for receiving movement information from the motion sensor(s) 102*a* and, when appropriate (depending upon the sensitivity level selected by the owner), activating an alarm with audio speaker 102*b*. State Machine 102*c* can be implemented in hardware, software, or any combination thereof. The interaction between state machine 102*c*, motion sensor(s) 102*a* and audio speaker 102*b* is explained in greater detail in connection with the description of FIG. 2 below.

Figure 2:
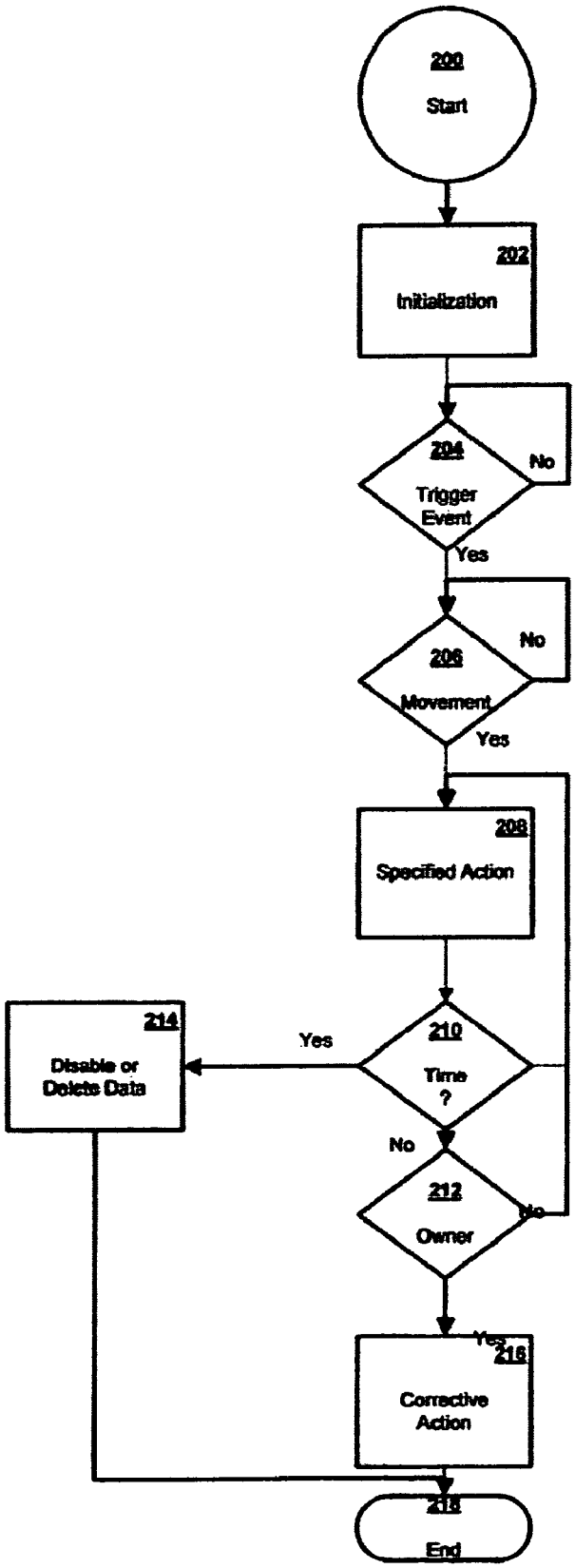
FIG. 2 is a flow chart illustrating the operation of the state machine of FIG. 1 according to the teachings of a preferred embodiment of the present invention.

Referring now to FIG. 2, a flow chart is shown illustrating the operation of the state machine 102*c* of FIG. 1 according to the teachings of a preferred embodiment of the present invention.

State machine 102*c* is initialized with various parameters such as the sensitivity range for the motion sensor(s) 102*a* (i.e. the types of movements that will trigger corrective action as described below) and the type of activities that will result in the activation of the state machine 102*c* (Step 202). The values for these parameters can be owner specified or set to defaults based upon a statistical analysis that is applicable for the particular mobile electronic device 100.

In the preferred embodiment of the present invention, state machine 102*a* is activated anytime the owner leaves the vicinity of the mobile electronic device 100. The triggering event for indicating when the owner has left the vicinity of the mobile electronic device can be, for example, in the form of a hot-key (e.g. function key F1), a password, or inactivity of the owner with the mobile electronic device itself 100.

State machine 102*c* monitors for the occurrence of the triggering event prior to proceeding to further action or execution (Step 204). Once the triggering event has occurred, the state machine 102*c* monitors the movement information provided by the motion sensor(s) 102*a* until a detected movement exceeds the predetermined level as previously specified in the initialization (Step 206).

When the detected movement exceeds the predetermined level, the state machine 102*c* takes a specified action intended to focus the attention of the owner such as sounding an alarm using audio speaker 102*b* (Step 208).

The specified action (e.g. sounding an alarm) continues until the owner identifies themselves to the mobile electronic device 100 such as by typing in a key, inserting a USB key, finger print identification and the like (Step 212), or a predetermined period of time has elapsed (Step 210).

If the repetition of the specified action exceeds the predetermined period of time, then further corrective action is taken (Step 214). The further correction action can be, for example, disabling the mobile electronic device (e.g. erasing a required eprom), erasing personal data, notifying the appropriate authorities, or other similar actions. Thereafter, state machine 102*c* completes its execution (Step 218).

If the owner identifies themselves to the mobile electronic device prior to the expiration of the specified time period, then corrective action is taken such as ceasing to sound the alarm (Step 216). Thereafter, state machine 102*c* completes its execution (Step 218).

Alternative Preferred Embodiment of the Present Invention

In an alternative preferred embodiment of the present invention, the mobile electronic device is a laptop having hardware implementations for motion sensor(s) 102*a* and speaker 102*b* while state machine 102*c* is implemented in software as described in connection with FIGS. 3 and 4 below.

Figure 3:
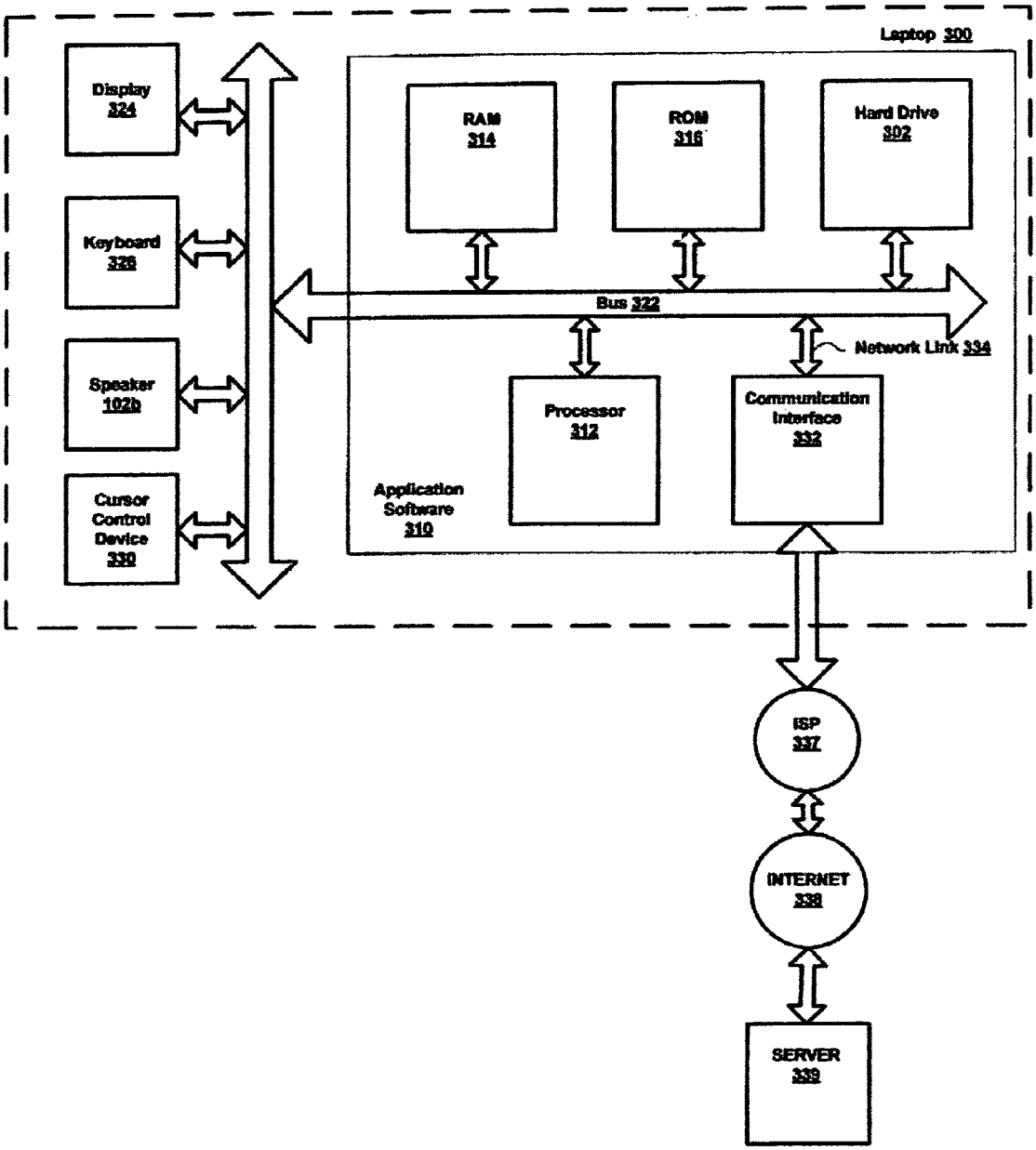
FIG. 3 is a block diagram illustrating a laptop that implements the theft deterrent system of FIG. 1 according to an alternative preferred embodiment of the present invention.

Referring now to FIG. 3, a block diagram is shown illustrating a Laptop 300 that implements the theft deterrent system 102 of FIG. 1 according to an alternative preferred embodiment of the present invention. Laptop 300 includes various components each of which are explained in greater detail below.

Bus 322 represents any type of device capable of providing communication of information within Laptop 300 (e.g., System bus, PCI bus, cross-bar switch, etc.) Processor 312 can be a general-purpose processor (e.g., the PowerPC™ manufactured by IBM or the Pentium™ manufactured by Intel) that, during normal operation, processes data under the control of an operating system and application software 310 stored in a dynamic storage device such as Random Access Memory (RAM) 314 and a static storage device such as Read Only Memory (ROM) 316. The operating system preferably provides a graphical user interface (GUI) to the user.

The present invention, including the alternative preferred embodiments, can be provided as a computer program product, included on a machine-readable medium having stored on it machine executable instructions used to program laptop 300 to perform a process according to the teachings of the present invention.

The term "machine-readable medium" as used in the specification includes any medium that participates in providing instructions to processor 312 or other components of laptop 300 for execution. Such a medium can take many forms including, but not limited to, non-volatile media, and transmission media. Common forms of non-volatile media include, for example, a floppy disk, a flexible disk, a hard disk, magnetic tape, or any other magnetic medium, a Compact Disk ROM (CD-ROM), a Digital Video Disk-ROM (DVD-ROM) or any other optical medium whether static or rewriteable (e.g., CDRW and DVD RW), punch cards or any other physical medium with patterns of holes, a programmable ROM (PROM), an erasable PROM (EPROM), electrically EPROM (EEPROM), a flash memory, any other memory chip or cartridge, or any other medium from which laptop 300 can read and which is suitable for storing instructions. In the alternative preferred embodiment, an example of a non-volatile medium is the Hard Drive 302.

Volatile media includes dynamic memory such as RAM 314. Transmission media includes coaxial cables, copper wire or fiber optics, including the wires that comprise the bus 322. Transmission media can also take the form of acoustic or light waves, such as those generated during radio wave or infrared data communications.

Moreover, the present invention can be downloaded as a computer program product where the program instructions can be transferred from a remote computer such as server 339 to requesting laptop 300 by way of data signals embodied in a carrier wave or other propagation medium via network link 334 (e.g., a modem or network connection) to a communications interface 332 coupled to bus 322.

Communications interface 332 provides a two-way data communications coupling to network link 334 that can be connected, for example, to a Local Area Network (LAN), Wide Area Network (WAN), or as shown, directly to an Internet Service Provider (ISP) 337. In particular, network link 334 may provide wired and/or wireless network communications to one or more networks.

ISP 337 in turn provides data communication services through the Internet 338 or other network. Internet 338 may refer to the worldwide collection of networks and gateways that use a particular protocol, such as Transmission Control Protocol (TCP) and Internet Protocol (IP), to communicate with one another. ISP 337 and Internet 338 both use electrical, electromagnetic, or optical signals that carry digital or analog data streams. The signals through the various networks and the signals on network link 334 and through communication interface 332, which carry the digital or analog data to and from laptop 300, are exemplary forms of carrier waves transporting the information.

In addition, multiple peripheral components can be added to laptop 300. For example, a speaker 102*b* is attached to bus 322 for controlling audio output. A display 324 is also attached to bus 322 for providing visual, tactile or other graphical representation formats. Display 324 can include both non-transparent surfaces, such as monitors, and transparent surfaces, such as headset sunglasses or vehicle windshield displays.

A keyboard 326 and cursor control device 330, such as mouse, trackball, or cursor direction keys, are coupled to bus 322 as interfaces for user inputs to laptop 300.

Figure 4:
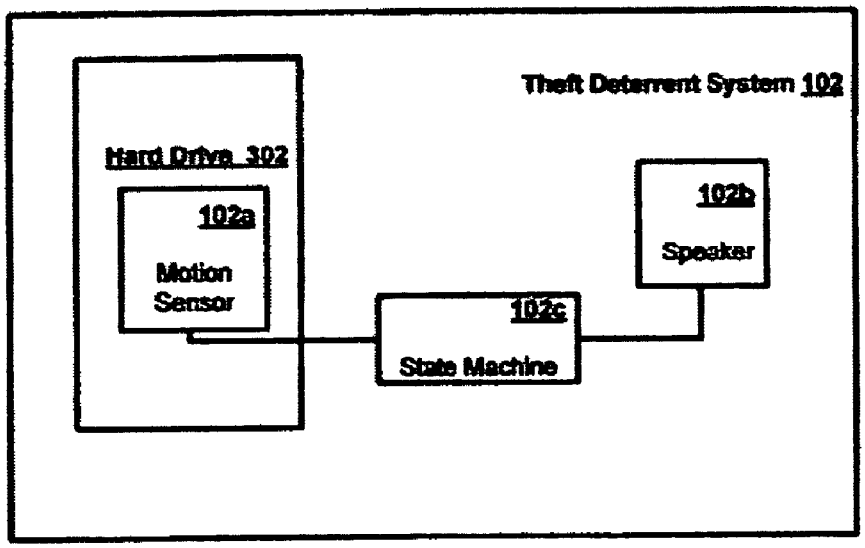
FIG. 4 is a block diagram illustrating selected components of the laptop of FIG. 3 that are involved in the implementation of the TDS of FIG. 1 according to an alternative preferred embodiment of the present invention.

Referring now to FIG. 4, a block diagram is shown illustrating selected components of laptop 300 that are involved in the implementation of the TDS 102 of FIG. 1 according to a preferred embodiment of the present invention. More specifically, hard drive 302, speaker 102*b* and state machine 102*c* are shown.

Hard drive 302 includes one or more motion sensor(s) 102*a* for implementing the capability of parking or otherwise physically moving the hard drive disk heads (not shown) so that damage does not occur to data being written to or read from while the laptop is being moved in a manner that could effect data integrity. An example of a laptop implementing such a data integrity system is the IBM ThinkPad™ R50 having Active Protection System™. It should also be noted, that although the motion sensor(s) 102*a* are being illustrated as physically residing within the hard drive 302 itself, the motion sensors could be located somewhere else within the laptop 300 (e.g. on the mother board).

In addition, the hard drive actuator (not shown) itself could also serve the purpose of a motion sensor by either monitoring its unintended movement or voltage variations.

In the preferred embodiment, the state machine 102*c* is implemented in software and can reside in RAM 314, ROM 316, hard drive 302 or any combination thereof. State machine 102*c* executes in accordance with the description provided with the flow chart illustrated in FIG. 2.

An example of a specific implementation of the alternative preferred embodiment of the present invention is explained below with reference to FIG. 2.

Referring again to FIG. 2, in this example, it can be assumed that the owner is using the laptop 300 in a restaurant and has proceeded to physically place the laptop 300 on a table in order to conduct some work. Some time later, the owner sees some friends being seated at a table on the other side of the restaurant and wishes to visit them. In this particular example, the state machine 102*c* has already been initialized (Step 202), the owner uses a password to activate the state machine 102*c* (Step 204), and proceeds to leave the vicinity to visit with the friends.

State machine 102*c* monitors the movement information provided by motion sensor(s) 102*a* until a detected movement exceeds the predetermined level as previously specified in the initialization (Step 206). It can be assumed for the moment that the owner has specified the predetermined level to be any movement of the laptop 300 from its current physical location (i.e. the table).

In this particular example, a waiter comes to the table and mistakenly believes that a customer has forgotten their laptop 300 and begins to physical move it to a safer location.

Upon detecting the movement of the laptop 300 from the table, state machine 102*c* sounds an alarm using audio speaker 102*b* (Step 208).

In this particular instance, the owner hears the alarm and realizes the waiter's mistake. The owner then proceeds to enter a password to disables the alarm (Step 216).

It should be noted that in the above example, with the exception of the state machine 102*c*, the existing components of the laptop 300 were used.

It should also be noted that as a result of power consumption considerations, current laptops do not have software or other means for powering the hard disk drive 302 when the laptop 300 itself is not being used or powered down. Consequently, n yet another alternative preferred embodiment of the present invention, the hard disk drive 302, speaker, and state machine are powered when the laptop is powered down or turned off. This modification can be accomplished in either software or hardware or some combination thereof.

It is thus believed that the operation and construction of the present invention will be apparent from the foregoing description. While the method, system, and computer program product shown and described has been characterized as being preferred, it will be readily apparent that various changes and/or modifications could be made without departing from the spirit and scope of the present invention as defined in the following claims.

What is claimed is:

1. A method of alerting an individual of unauthorized movement of a mobile electronic device having a hard disk drive with a motion sensor, the method comprising the steps of:

receiving a triggering event to begin monitoring a movement of the mobile electronic device;

detecting the movement of the mobile electronic device from a physical location using the motion sensor; and alerting the individual of the movement, wherein the movement is unauthorized if the movement exceeds a value of a predetermined parameter and wherein the predetermined parameter is determined by one of a setting provided by the individual or a default value based upon statistical analysis applicable for the mobile electronic device.

2. The method of claim 1 further comprising the step of:

destroying data stored on the mobile electronic device if the individual fails to take a predetermined action after a predetermined period of time has elapsed since the movement of the mobile electronic device.

3. The method of claim 2 wherein the predetermined parameter is distance.

4. The method of claim 1 wherein the step of alerting includes:

sounding an alarm.

5. The method of claim 1 wherein the step of alerting includes:

providing a visual warning.

6. The method of claim 1, wherein the triggering event is in the form of at least one of a hot-key, a password, and inactivity of the individual with respect to the mobile electronic device.

7. The method of claim 1, further comprising:

discontinuing alerting the individual when a Universal Serial Bus key is inserted into the mobile electronic device.

8. The method of claim 1, further comprising:

discontinuing alerting when fingerprint identification is confirmed.

9. An apparatus for alerting an individual of unauthorized movement of a mobile electronic device having a hard disk drive with a motion sensor, the apparatus comprising:

means for receiving a triggering event to begin monitoring a movement of the mobile electronic device;

means for detecting the movement of the mobile electronic device from a physical location using the motion sensor; and means for alerting the individual of the movement, wherein the movement is unauthorized if the movement exceeds a value of a predetermined parameter and wherein the predetermined parameter is determined by one of a setting provided by the individual or a default value based upon statistical analysis applicable for the mobile electronic device.

10. The apparatus of claim 9 further comprising:

means for destroying data stored on the mobile electronic device if the individual fails to take a predetermined action after a predetermined period of time has elapsed since the movement of the mobile electronic device.

11. The apparatus of claim 10 wherein the predetermined parameter is distance.

12. The apparatus of claim 9 wherein the means for alerting includes:

means for sounding an alarm.

13. The apparatus of claim 9 wherein the means for alerting includes:

means for providing a visual warning.

14. A computer program product comprising a computer usable medium having computer usable program code for alerting an individual of unauthorized movement of a mobile electronic device having a hard disk drive with a motion sensor, the computer program product including:

computer usable program code for receiving a triggering event to begin monitoring a movement of the mobile electronic device;

computer usable program code for detecting the movement of the mobile electronic device from a physical location using the motion sensor; and computer usable program code for alerting the individual of the movement, wherein the movement is unauthorized if the movement exceeds a value of a predetermined parameter and wherein the predetermined parameter is determined by one of a setting provided by the individual or a default value based upon statistical analysis applicable for the mobile electronic device.

15. The computer program product of claim 14 further comprising:

computer usable program code for destroying data stored on the mobile electronic device if the individual fails to take a predetermined action after a predetermined period of time has elapsed since the movement of the mobile electronic device.

16. The computer program product of claim 14 wherein the predetermined parameter is distance.

17. The computer program product of claim 14 wherein the computer usable program code for alerting includes:

computer usable program code for sounding an alarm.

18. The computer program product of claim 14, wherein the triggering event is in the form of at least one of a hot-key, a password, and inactivity of the owner with respect to the mobile electronic device.

19. The computer program product of claim 14, further comprising:

computer usable program code for discontinuing alerting when a Universal Serial Bus key is inserted into the mobile electronic device.

20. The computer program product of claim 14, further comprising:

computer usable program code for discontinuing alerting when fingerprint identification is confirmed.

* * * * *